US006428422B1

(12) United States Patent
Bennett

(10) Patent No.: US 6,428,422 B1
(45) Date of Patent: Aug. 6, 2002

(54) GOLF CLUB HOLDER

(76) Inventor: Robert A. Bennett, 120 Sheffield Cir., Stratford, CT (US) 06614

( * ) Notice: Subject to any disclaimer, the term of this patent is extended or adjusted under 35 U.S.C. 154(b) by 39 days.

(21) Appl. No.: 09/771,867

(22) Filed: Jan. 29, 2001

(51) Int. Cl.[7] ..... A63B 55/10
(52) U.S. Cl. ..... 473/282; 248/520
(58) Field of Search ..... 43/21.2; 211/70.2; D21/796; 42/94; 473/282, 286, 408; 269/254 CS; 248/520, 175

(56) References Cited

U.S. PATENT DOCUMENTS 3,539,017 A * 11/1970 Johnson
4,862,970 A * 9/1989 Hlavacek
5,388,824 A * 2/1995 Reimers
5,449,169 A * 9/1995 Hardin
5,482,247 A * 1/1996 Smith
5,492,230 A * 2/1996 Horton
6,283,875 B1 * 9/2001 Jones

* cited by examiner

*Primary Examiner*—Stephen Blau

(57) ABSTRACT

A golf club holder adapted for removably supporting a golf club above a ground surface in such manner that the club has a head which contacts the surface and the club has a shaft which extends above the surface.

6 Claims, 2 Drawing Sheets

FIG. 7
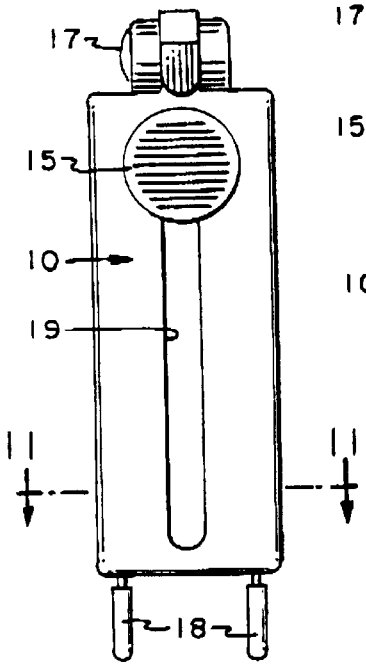
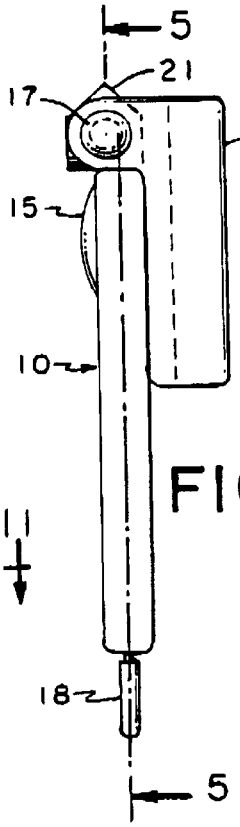
FIG. 4
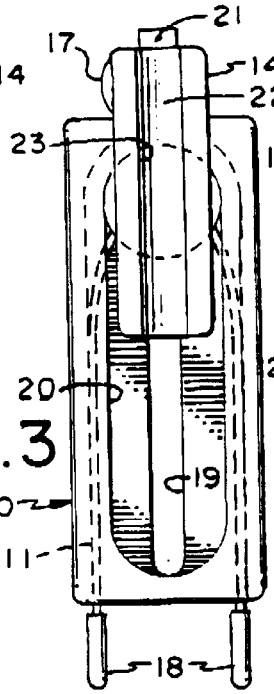
FIG. 5
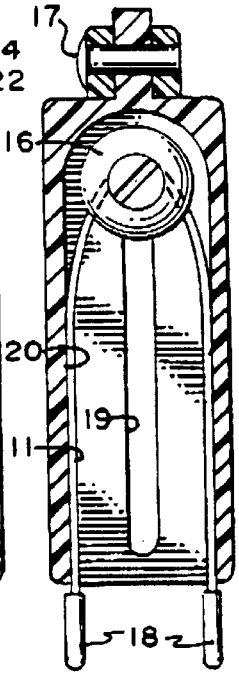
FIG. 3
FIG. 8
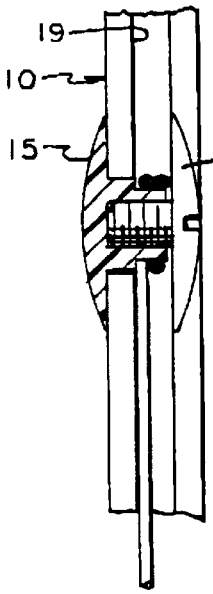
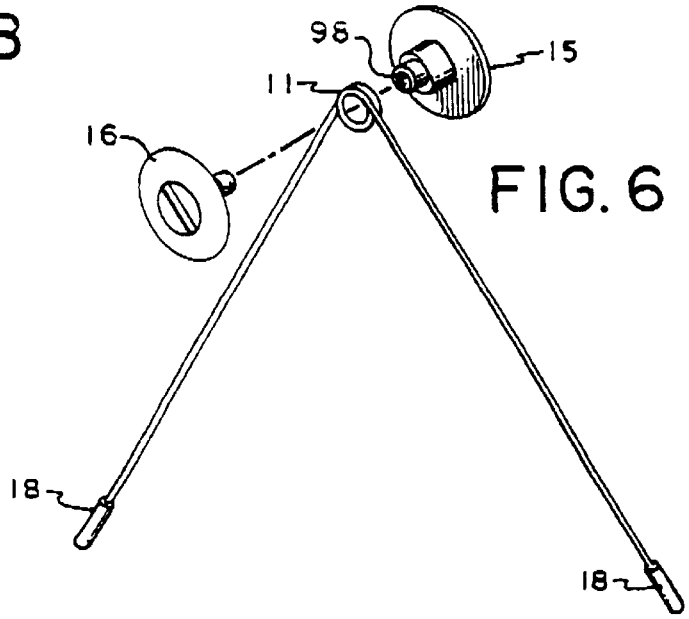
FIG. 6

GOLF CLUB HOLDER

BACKGROUND OF THE INVENTION

A golfer driving a golf ball onto or adjacent a green of a hole often carries two clubs, one club being an iron to be used in making an approach shot, the other club being a putter for attempting to sink the ball into the hole cup. When the golfer is using one club, the other club is often placed on the ground. As a result, the handle of the other club often becomes wet and difficult to use. Moreover, the golfer may forget, walk away and leave the unused club on the ground.

The present invention is directed toward a new type of golf holder which can be used to temporarily hold the other club in such manner that it is positioned above the ground and the handle remains dry and easy to use.

SUMMARY OF THE INVENTION

In accordance with the principles of this invention, a golf club holder is adapted for removably supporting a golf club above a ground surface in such manner that the club has a head which contacts the surface and the club has a shaft which extends above the surface.

The holder utilizes a coil spring having a horizontal axis. The spring has first and second opposite ends, each end being integrally secured to a corresponding one of first and second like elongated supporting legs. The spring has a wound position at which the two legs are disposed in closely spaced vertically downwardly extending orientation and has an unwound position at which the legs extend downwardly and outwardly away from each other and define two legs of a triangle.

The spring cooperates with a vertically elongated plate having a vertical slot. Means manually slidable in said slot is secured to the spring. The means has a raised position in which the means places the spring in wound position, the axis of the spring being disposed at right angles to the slot.

An elongated member has an upper end pivotally secured to the upper end of the plate and has an axially extending channel in which the club shaft can be removably snap fitted.

In use the member is disposed in vertically inclined position with its lower end disposed above the ground. The means is manually slid downward in the slot until the legs define two legs of a triangle with their lower ends resting on top of the ground. The shaft of the other club is detachably snap fitted in the channel of the member with the head of the club resting on top of the ground.

Thus the head of the club and the two legs form a stable tripod for detachably storing the unused club in the manner previously described.

DESCRIPTION OF THE DRAWINGS

FIG. 3 is a vertical side view of the holder with the gold club removed and the manually operative means maintaining the spring in wound position.

FIG. 4 is a rear detail cross sectional view of the manually operative means and slotted plate.

FIG. 5 is a front detail sectional view of the structure shown in FIG. 4.

FIG. 6 is a perspective exploded view of the spring and manually operative means.

FIG. 7 is a rear view of the holder with the golf club removed.

FIG. 8 is a detail vertical cross sectional view of the manually operative means and spring.

DESCRIPTION OF PREFERRED EMBODIMENT

Figure 1:
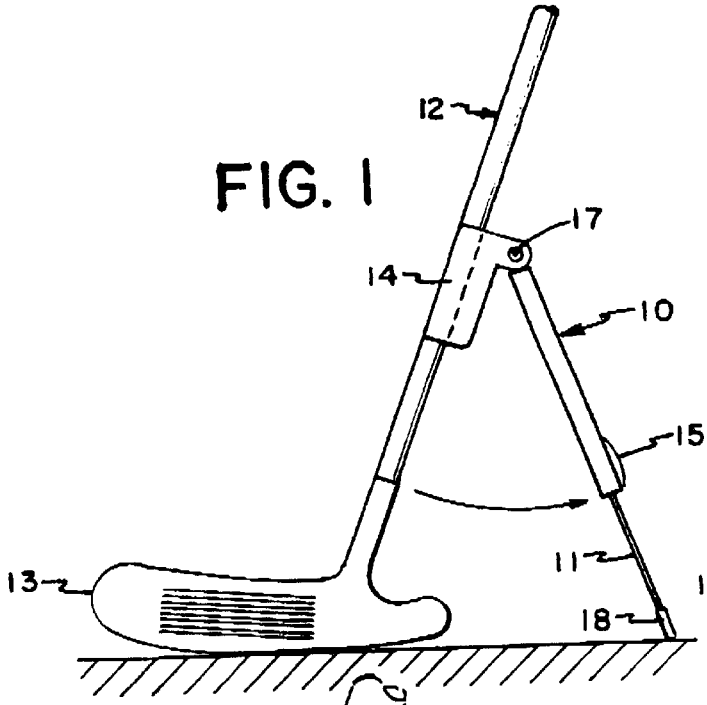
FIG. 1 is a side view showing the holder in use with a golf club detachably stored therein.
Figure 2:
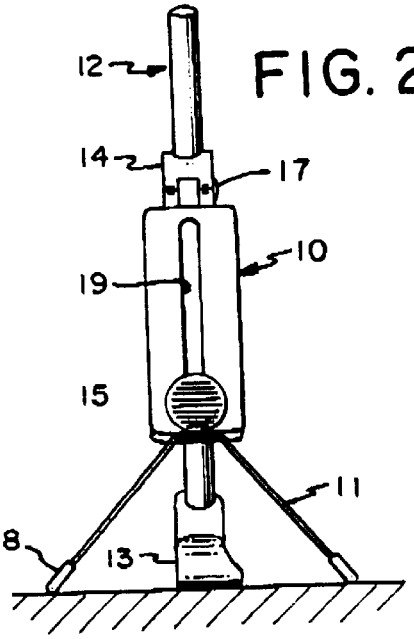
FIG. 2 is a rear view of the structure shown in FIG. 1.
Figure 9:
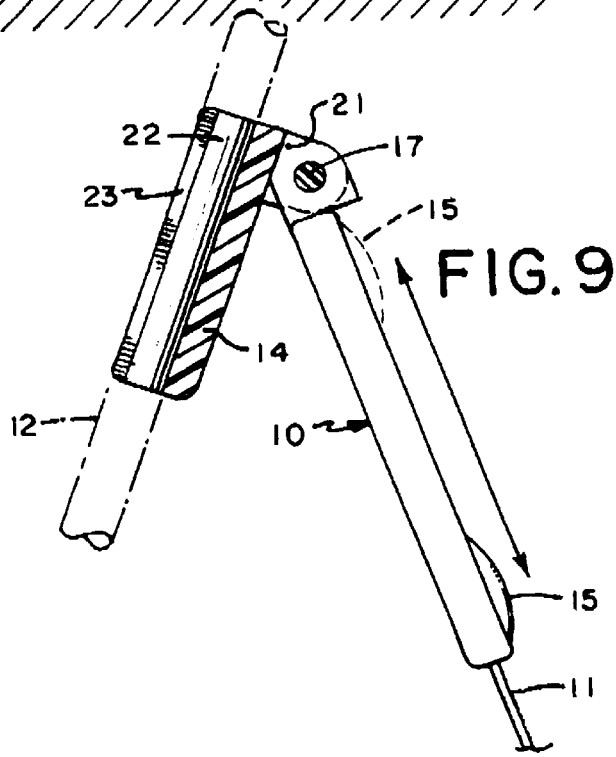
FIG. 9 is a partially cut away side view of the holder showing a portion of the club and legs.
Figure 10:
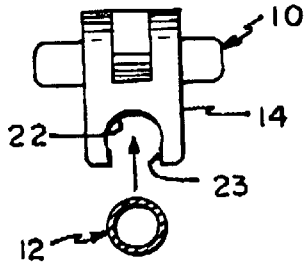
FIG. 10 is a top view of the holder and shaft.
Figure 11:
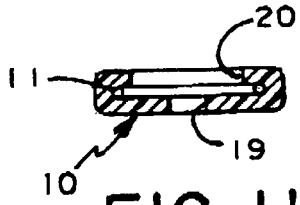
FIG. 11 is a cross sectional view of the plate as shown in FIG. 7.

As shown in FIGS. 1–11 golf club holder is adapted for removably supporting a golf club above a ground surface 100 in such manner that the club has a head 13 which contacts the surface and the club has a shaft 12 which extends above the surface.

The holder uses a coil spring 11 having a horizontal axis, the spring having first and second opposite ends, each end being integrally secured to a corresponding one of first and second like elongated supporting legs 18. The spring has a wound position at which the two legs are disposed in closely spaced vertically downwardly extending orientation and having an unwound position as shown at which the legs extend downwardly and outwardly away from each other and define two legs of a triangle.

The holder uses a vertically elongated plate 10 having a vertical slot 19. The axis of the spring is disposed at right angles to the slot. Means manually slidable in said slot and secured to the spring takes the form of a push button 16 which extends through the spring and threadedly engages receiving sleeve 98 on an opposite button 15. Rotation of button 16 in one direction prevents rotation of the spring and enables it to be moved to raised position in said slot whereby the spring is wound position. When the button is rotated in opposite direction, the spring is released and enables it to be moved in lowered position.

An elongated member 14 has an upper end pivotally secured to the upper end of the plate and has an axially extending channel 22 having a flat 23 in which the club shaft 12 can be removably snap fitted.

The upper end of member 14 is secured by pivot pin 17 to stop 21. The stop opens to an angle of forty five degrees, but will not open further, thus stabilizing the tripod action.

While the invention has been described with particular reference to the drawings and detailed description, the protection solicited is to be limited only by the terms of the claims which follow.

What is claimed is:

1. A golf club holder ad ably supporting a golf club above a ground surface in such manner that the club has a head which contacts the surface and the club has a shaft which extends above the surface, said holder comprising:

a coil spring having a horizontal axis, the spring having first and second opposite ends, each end being integrally secured to a corresponding one of first and second elongated supporting legs, said spring having a wound position at which the two legs are disposed in closely spaced vertically downwardly extending orientation and having an unwound position at which the legs extend downwardly and outwardly away from each other and define two legs of a triangle;

a first vertically elongated member having a vertical slot;

means manually slidable in said slot and secured to the spring, said means having a raised position in said slot at which the means places the spring in wound position and has a lowered position at which the means places the spring in unwound position, the axis of the spring being disposed at right angles to the slot; and a second elongated member having an upper end pivotally secured to the upper end of the first member and having an axially extending channel in which the club shaft can be removably snap fitted.

2. The holder of claim 1 wherein the upper end of the second member is pivotally secured to the upper end of first member in such manner that the angle of pivot cannot exceed 45 degrees.

3. The holder of claim 2 wherein the first member is a plate.

4. The holder of claim 3 wherein the second member has an inner surface which is cylindrical.

5. The holder of claim 4 wherein a lower end of the second member is disposed above the legs.

6. The holder of claim 5 wherein when the shaft is snap fitted to the inner surface of the second member and the head of the club is disposed below the lower end of the second member.

* * * * *